US009441307B2

(12) United States Patent
Al-Zahrani

(10) Patent No.: US 9,441,307 B2
(45) Date of Patent: Sep. 13, 2016

(54) CATHODIC PROTECTION AUTOMATED CURRENT AND POTENTIAL MEASURING DEVICE FOR ANODES PROTECTING VESSEL INTERNALS

(71) Applicant: Saudi Arabian Oil Company, Dhahran (SA)

(72) Inventor: Mohammad G. Al-Zahrani, Abqaiq (SA)

(73) Assignee: Saudi Arabian Oil Company, Dhahran (SA)

( * ) Notice: Subject to any disclaimer, the term of this patent is extended or adjusted under 35 U.S.C. 154(b) by 74 days.

(21) Appl. No.: 14/099,652

(22) Filed: Dec. 6, 2013

(65) Prior Publication Data

US 2015/0159280 A1 Jun. 11, 2015

(51) Int. Cl.
*C23F 13/00* (2006.01)
*C23F 13/04* (2006.01)
(Continued)

(52) U.S. Cl.
CPC ..... *C23F 13/04* (2013.01); *C23F 13/22* (2013.01); *C23F 13/14* (2013.01)

(58) Field of Classification Search
CPC ..... C23F 13/02; C23F 13/04; C23F 13/06; C23F 2213/10; C23F 2213/20; C23F 2213/21; C23F 2213/31; C23F 13/08; C23F 13/10; C23F 13/18; C23F 13/22; C23F 2213/00–2213/11; C23F 2213/30–2213/32
USPC ..... 204/196.01, 196.02, 196.04, 196.06, 204/196.07, 196.37; 205/724, 725, 740
See application file for complete search history.

(56) References Cited

U.S. PATENT DOCUMENTS 3,346,508 A * 10/1967 Thompson ..... C10G 33/02 196/46
3,987,476 A 10/1976 Sittig
4,397,726 A * 8/1983 Schwert ..... C23F 13/02 204/196.18

(Continued)

FOREIGN PATENT DOCUMENTS

CA 2577375 A1 2/2006
CN 101705491 A 5/2010

(Continued)

OTHER PUBLICATIONS

PCT International Search Report and the Written Opinion; dated Apr. 22, 2015; International Application No. PCT/US2014/067844; International File Date: Dec. 1, 2014.

(Continued)

*Primary Examiner* — Luan Van
*Assistant Examiner* — Alexander W Keeling
(74) *Attorney, Agent, or Firm* — Bracewell LLP; Constance G. Rhebergen; Vivek P. Shankam

(57) ABSTRACT

Embodiments of systems and methods for providing cathodic protection to a fluid-containing vessel include measuring two distinct voltages at a junction box exterior to the fluid-containing vessel. The first voltage is measured across a shunt in the junction box such that a current magnitude through the shunt can be determined using Ohm's Law that is representative of a current output of one or more sacrificial anodes disposed within the fluid-containing vessel. The second voltage is measured by depressing a pushbutton of a momentary switch to open the switch and interrupt current flow through the shunt. The second voltage is representative of a voltage difference between the one or more sacrificial anodes and the a wall of the fluid-containing vessel.

16 Claims, 3 Drawing Sheets

(51) Int. Cl.

| | |
|---|---|
| ***C23F 13/22*** | (2006.01) |
| *C23F 13/14* | (2006.01) |

(56) References Cited

U.S. PATENT DOCUMENTS

| | | | | |
|---|---|---|---|---|
| 4,536,274 | A | | 8/1985 | Papadakis et al. |
| 4,778,949 | A | | 10/1988 | Esterle et al. |
| 4,783,896 | A | | 11/1988 | Stubbe et al. |
| 4,812,212 | A | | 3/1989 | Dimond et al. |
| 4,894,135 | A | | 1/1990 | Farque |
| 5,305,631 | A | * | 4/1994 | Whited et al. ..... 73/49.2 |
| 5,316,641 | A | * | 5/1994 | Wright et al. ..... 204/196.15 |
| 5,318,678 | A | | 6/1994 | Callot |
| 5,384,020 | A | | 1/1995 | Oppermann et al. |
| 5,574,610 | A | | 11/1996 | Tachick et al. |
| 5,847,504 | A | | 12/1998 | Baldi |
| 5,897,755 | A | | 4/1999 | Star et al. |
| 6,224,742 | B1 | | 5/2001 | Doniguian |
| 6,315,876 | B1 | * | 11/2001 | Delahoyde et al. ..... 204/196.06 |
| 6,387,244 | B1 | | 5/2002 | Lyublinski |
| 7,192,513 | B2 | | 3/2007 | Al-Mahrous |
| 7,238,263 | B2 | | 7/2007 | Howard, Jr. et al. |
| 7,285,203 | B2 | | 10/2007 | Russell et al. |
| 7,489,045 | B1 | | 2/2009 | Bradford et al. |
| 7,585,397 | B2 | | 9/2009 | Bollinger |
| 7,868,475 | B1 | | 1/2011 | Bradford et al. |
| 7,883,608 | B2 | | 2/2011 | Hiner et al. |
| 8,111,078 | B1 | | 2/2012 | Yang et al. |
| 8,137,528 | B2 | | 3/2012 | Heselmans |
| 8,143,805 | B2 | | 3/2012 | Peng |
| 8,143,806 | B2 | | 3/2012 | Mosebrook et al. |
| 8,144,025 | B2 | | 3/2012 | Mackenzie, IV et al. |
| 8,144,921 | B2 | | 3/2012 | Ke et al. |
| 8,148,851 | B2 | | 4/2012 | Hahnlen et al. |
| 8,152,546 | B2 | | 4/2012 | Gosling et al. |
| 8,153,910 | B1 | | 4/2012 | Penczak |
| 8,154,700 | B2 | | 4/2012 | Prakash et al. |
| 8,154,903 | B2 | | 4/2012 | Jung et al. |
| 8,155,809 | B1 | | 4/2012 | Bilodeau et al. |
| 8,211,289 | B2 | | 7/2012 | Glass et al. |
| 8,226,812 | B2 | | 7/2012 | Nelvig et al. |
| 8,273,239 | B2 | | 9/2012 | Glass et al. |
| 8,310,251 | B2 | | 11/2012 | Orazem |
| 2006/0070871 | A1 | | 4/2006 | Bushman et al. |
| 2007/0035315 | A1 | | 2/2007 | Hilleary |

FOREIGN PATENT DOCUMENTS

| | | | | |
|---|---|---|---|---|
| DE | 3403339 | A1 | 8/1985 | |
| GB | 2019000 | A * | 10/1979 | ..... 204/196.01 |
| WO | 2008110625 | A1 | 9/2008 | |

OTHER PUBLICATIONS

"Boxes & Brackets", Home Depot, pp. 1-6,www.homedepot.com/webapp/catalog/servlet/Navigation?storeId=1005I&langId=-I&catalogId=10053&N=5yclvZbohnZIz116nv.

"Cathodic Protection Junction Boxes & Rectifiers", Brance-Krachy Co., Inc., pp. 1, www.brancekrachy.com/catalog/index.php?cPath=I_147.

"Cathodic Protection System", Mitcorr Cathodic Protection Private Limited, pp. 1-2, www.indiamart.com/mcppl/cathodic-protection-system.html.

"Junction Box", Wikipedia the free encyclopedia, 2013, pp. 1-2, en.wikipedia.org/wiki/Junction_box.

Marcel Moreau, "Testing Cathodic-Protection Systems", Supplement to Lustline 64, pp. 1-5.

Scott et al., "Cathodic Protection Monitoring Via In-Line Inspection", Pigging Products and Services Association, 2007, pp. 1-7.

Tatum, "What is a Junction Box" Wise GEE, 2013, pp. 1-5, Conjecture Corporation, http://www.wisegeek.com/what-is-a-junction-box.htm.

* cited by examiner

CATHODIC PROTECTION AUTOMATED CURRENT AND POTENTIAL MEASURING DEVICE FOR ANODES PROTECTING VESSEL INTERNALS

BACKGROUND OF THE INVENTION

1. Field of the Invention

Embodiments of the present invention relate generally to cathodic protection of structures in corrosive environments. In particular, embodiments of the invention relate to systems and methods for monitoring the condition of galvanic anodes disposed internally within a fluid-containing vessel for the cathodic protection of the fluid-containing vessel.

2. Description of the Related Art

Cathodic protection systems are often employed for the protection of metallic structures from corrosion. The protected metallic structures are arranged to serve as a cathode in an electrical circuit such that oxidation of the metallic structures are restricted. A sacrificial anode is often supplied to the circuit to support a net oxidation reaction.

One type of metallic structure that is often protected by a cathodic protection system is a fluid-containing vessel such as a storage tank, cylinder, settling tank or process equipment for processing fluids associated with the production of energy. These fluid-containing vessels generally include an interior chamber in which a corrosive fluid is stored and isolated from an exterior environment. A galvanic anode, such as a magnesium, aluminum or zinc anode, is often disposed within the interior chamber to protect structural steel portions of the fluid-containing vessel. Magnesium anodes often demonstrate high potential and, thus, corrode in less than one year in vessel protection applications. Aluminum anodes are also consumed rapidly, particularly when the temperature is more than 50° C. in the vessel. Typical zinc anodes are not consumed as quickly, but tend to reverse polarity at higher temperatures. Thus, typical zinc anodes can cease serving as protective anodes, and become the cathode in the electrical circuit at high temperature. High-temperature zinc ("HTZ") anodes are often used in vessels at temperatures above 50° C. and up to 70° C., and exhibit a longer service life than typical zinc anodes.

Frequent monitoring of the condition of galvanic anodes is required to verify wear levels of the galvanic anodes and proper operation of the cathodic protection system. Direct observation of the galvanic anodes is often not feasible due to their location within the interior chamber of the fluid-containing vessel. Current and voltage measurements associated with the cathodic protection system enable an operator to assess the wear conditions of these galvanic anodes, but taking these measurements can be a dangerous, time-consuming and labor-intensive process.

SUMMARY OF THE INVENTION

Described herein are systems and methods for monitoring the operation of a cathodic protection system for the protection of a fluid-containing vessel. Embodiments of the systems and methods include measurements of both current and voltages associated with the cathodic protection system to assess the wear conditions of galvanic anodes. The systems facilitate the necessary measurements in a safe and efficient manner.

According to one aspect of the invention, a cathodic protection system includes a fluid-containing vessel having a wall that defines an interior surface. A fluid is disposed within the fluid-containing vessel that contacts the interior surface of the wall. A plurality of protecting anodes is disposed within the fluid-containing vessel. The protecting anodes are spaced apart from one another, each contact the fluid, and are each directly connected to the interior surface of the wall through an electrical conduit fluidly isolated from the fluid. One or more monitoring anodes is disposed within the fluid-containing vessel, and a junction box is disposed on an exterior of the fluid-containing vessel. The junction box includes a shunt coupled between an anode electrical line and a vessel electrical line. The anode electrical line extends from the one or more monitoring anodes through the wall of the fluid-containing vessel to the shunt and the vessel electrical line extends from the wall of the fluid-containing vessel to the shunt. The shunt has a known electrical resistance such that a current through the shunt is calculable from a measurement of a voltage across the shunt using Ohm's Law. A momentary switch is disposed in one of the anode electrical line and the vessel electrical line, and has a normally closed configuration to permit current flow therethrough. The momentary switch is operable to be momentarily opened to inhibit current flow through the shunt and thereby permit a voltage measurement between the anode electrical line and the vessel electrical line that is representative of a voltage difference between the one or more monitoring anodes and the wall of the fluid-containing vessel.

In some embodiments, the cathodic protection system further includes one or more anode mounts coupled to the interior surface, and one or more protecting anodes of the plurality of protecting anodes are mounted on the one or more anode mounts. A respective electrical conduit that is fluidly isolated from the fluid extends through the anode mount to which a respective one of the protecting anodes of the plurality of protecting anodes is mounted. In some embodiments, one or more of the protecting anodes of the plurality of protecting anodes are mounted directly to the interior surface.

In some embodiments, the cathodic protection system further includes an impressed current source electrically connected to one or more of the plurality of protecting anodes and to the wall of the fluid-containing vessel. The fluid-containing vessel serves as a cathode when current is applied from the impressed current source.

In some embodiments, the junction box further includes a first pair of potential knobs protruding from a surface thereof and disposed on opposite sides of the shunt to facilitate the measurement of the voltage across the shunt. In some embodiments, the junction box further includes a second pair of potential knobs to facilitate the voltage measurement between the anode electrical line and the vessel electrical line while the momentary switch is momentarily opened. A first one of the second pair of potential knobs is in electrical communication with the anode electrical line and a second one of the second pair of potential knobs is in electrical communication with the vessel electrical line. In some embodiments, the cathodic protection system further includes a portable, hand-held voltage meter operable to make voltage measurements between the first pair of potential knobs and between the second pair of potential knobs.

According to another aspect of the invention, a method of monitoring the one or monitoring anodes of the cathodic protection system includes the steps of (a) engaging a pair of leads of the portable, hand-held voltage meter with the first pair of potential knobs and recording a first indicated voltage, (b) engaging the momentary switch to momentarily open the momentary switch and interrupt current through the shunt, (c) engaging the pair of leads of the portable, hand-held voltage meter with the second pair of potential knobs while current is interrupted through the shunt and recording a second voltage and (d) disengaging the momentary switch to restore current through the shunt.

According to another aspect of the invention, a cathodic protection system for providing corrosion protection to a fluid-containing vessel includes a fluid-containing vessel defining an interior chamber for containing a fluid therein. One or more sacrificial anodes is disposed within the interior chamber, and a shunt is disposed on an exterior of the fluid-containing vessel. The shunt has a known electrical resistance such that a current through the shunt is calculable from a measurement of a voltage across the shunt using Ohm's Law. An anode electrical line extends through a wall of the fluid-containing vessel from the one or more monitoring anodes to a first end of the shunt. A vessel electrical line extends from the fluid-containing vessel to a second end of the shunt such that the shunt is connected in series between the anode electrical line and the vessel electrical line. A momentary switch is disposed in one of the anode electrical line and the vessel electrical line, The momentary switch has a normally closed configuration to permit current flow therethrough, and is operable to be momentarily opened to interrupt current flow through the shunt to thereby permit a voltage measurement between the anode electrical line and the vessel electrical line that is representative of a voltage difference between the one or more sacrificial anodes and an interior surface of the wall of the fluid-containing vessel.

In some embodiments, the shunt and the momentary switch are disposed within a junction box disposed on the exterior of the fluid-containing vessel. In some embodiments, a first pair of potential knobs is disposed within the junction box on opposite sides of the shunt to facilitate the measurement of the voltage across the shunt. In some embodiments, the cathodic protection system further includes a second pair of potential knobs to facilitate the voltage measurement between the anode electrical line and the vessel electrical line while the momentary switch is momentarily opened. A first one of the second pair of potential knobs is in electrical communication with the anode electrical line and a second one of the second pair of potential knobs is in electrical communication with the vessel electrical line.

In some embodiments, the fluid-containing vessel includes a dehydrator for handling wet crude, and one or more of the sacrificial anodes are disposed along a lower interior surface of the fluid-containing vessel within the interior chamber. In some embodiments, the one or more sacrificial anodes are includes one or more monitoring anodes electrically coupled directly to the anode electrical line and one or more protecting anodes electrically isolated from the anode electrical line except through the fluid-containing vessel or the fluid contained therein. In some embodiments, the one or more sacrificial anodes comprises at least one high temperature zinc anode.

BRIEF DESCRIPTION OF THE DRAWINGS

So that the manner in which the above-recited features, aspects and advantages of the invention, as well as others that will become apparent, are attained and can be understood in detail, a more particular description of the invention briefly summarized above may be had by reference to the embodiments thereof that are illustrated in the drawings that form a part of this specification. It is to be noted, however, that the appended drawings illustrate only preferred embodiments of the invention and are, therefore, not to be considered limiting of the invention's scope, for the invention may admit to other equally effective embodiments.

DETAILED DESCRIPTION OF THE EXEMPLARY EMBODIMENTS

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art.

Figure 1:
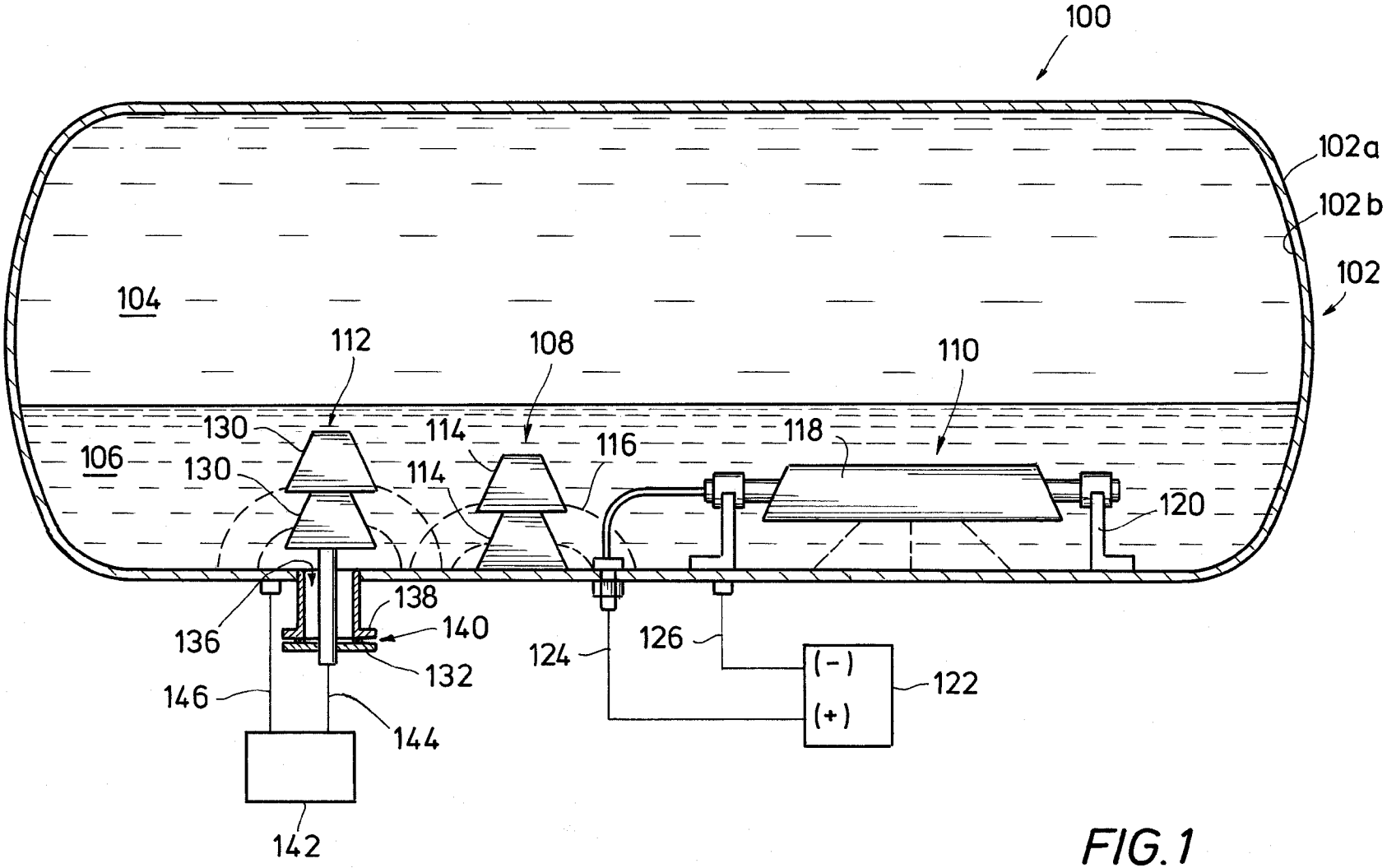
FIG. 1 is a schematic cross-sectional view of a fluid-containing vessel with a cathodic protection system including protective anodes and monitoring anodes in accordance with an example embodiment of the present invention.

Cathodic protection system 100 is depicted in FIG. 1. Cathodic protection system 100 includes fluid-containing vessel 102, which includes wall 102*a* having interior surface 102*b*. Wall 102*a* of fluid-containing vessel 102 is constructed of steel and is configured for storing or separating a fluid such as wet crude in an interior chamber of fluid-containing vessel 102. As one of skill in the art will appreciate, wet crude is crude oil having droplets of water suspended therein. Over time, the water droplets separate from the crude oil such that first liquid phase 104 of predominantly crude oil floats on second liquid phase 106 of predominantly water. The first liquid phase and the second liquid phase both contact the interior surface 102*b*. Corrosion of fluid-containing vessel 102 is more prominent in portions of fluid-containing vessel 102 in contact with second phase 106, although corrosion occurs all portions of fluid-containing vessel 102. The pace of corrosion can be high due to conditions inside fluid-containing vessel 102. For example, the first phase 104 or second phase 106 can have low resistivity, high temperature, high total dissolved solids, and a high percentage of $H_2S$. Temperatures can be, for example, in excess of 50 degrees C. In the embodiment depicted, fluid-containing vessel 102 is the structure protected by cathodic protection system 100. In other embodiments (not shown), fluid-containing vessel 102 can be other types of vessels such as an upright cylinder or process equipment used to process fluids associated with the production of energy. In embodiments, fluid-containing vessel 102 can include, for example, a high pressure production trap, a low pressure production trap, a water and oil separation plant, a desalter, and/or a dehydrator.

One or more protective anode assemblies 108, 110 are positioned within fluid-containing vessel 102 for providing corrosion protection to fluid-containing vessel 102, and one or more monitoring anode assemblies 112 are positioned within fluid-containing vessel 102 to facilitate assessing the condition of anode assemblies, 102, 110 and 112. As described in greater detail below, protective anode assembly 108 and protective anode assembly 110 each represent an example of a different type of anode assembly used in cathodic protection systems generally known respectively as galvanic anode cathodic protection ("GACP") systems and impressed-current cathodic protection ("ICCP") systems. Cathodic protection system 100 includes both types of protective anode assemblies 108, 110 together in a single fluid-containing vessel 102. In other embodiments (not shown), only one type of protective anode assembly, e.g., 108 or the other, e.g., 110 is disposed in a fluid-containing vessel 102. Protective anode assemblies 108, 110 are spaced apart around interior surfaces of fluid-containing vessel 102. In some embodiments, cathodic protection system 100 includes fifty (50) or more protective anode assemblies 108, 110, although more or fewer anode assemblies 108, 110 are be employed in other embodiments.

Protective anode assembly 108 includes one or more protective anodes 114 mounted directly to interior surface 102*b* of wall 102*a*, or mounted directly to another protective anode 114. A direct electrical connection is thus established between protective anodes 114 and the fluid-containing vessel 102 such that electric current flows directly between protective anodes 114 and wall 102*a* of fluid-containing vessel 102. As one of skill in the art will appreciate, protective anodes 114 have more negative electrochemical potential than fluid-containing vessel 102, so that electric current flows from fluid-containing vessel 102 to protective anodes 114. Ions 116 also flow from protective anodes 114 to fluid-containing vessel 102, and protective anodes 114 provide corrosion protection to the fluid-containing vessel 102.

Protective anode assembly 110 includes one or more protective anodes 118 mounted on and electrically connected to anode mount 120. Anode mount 120 is mechanically and/or electrically connected to the interior surface of fluid-containing vessel 102 so that electric current can flow between anode mount 120 and fluid-containing vessel 102. Anode mounts 120 provide an electrical conduit extending therethrough that is fluidly isolated from fluid 104, 106. Thus protective anodes 118 are directly coupled to fluid containing vessel 102 through a conduit that does not extend through fluid 104, 106.

Protective anode 118 is electrically coupled to impressed current source 122 by a positive line 124 and fluid-containing vessel 102 is electrically coupled to external power supply 124 by negative line 126. In some embodiments, impressed current source 122 is provided an external, direct current ("DC") power source for impressing or driving an electric current through cathodic protection system 100. The electric current flows through cathodic protection system 100 encouraging corrosion of protective anodes 118 and thereby discouraging corrosion of fluid-containing vessel 102 since fluid-containing vessel 102 acts as a cathode when current is applied from the impressed current source 122.

Monitoring anode assembly 112 includes one or more monitoring anodes 130 mounted on anode mount 132. Monitoring anode assembly 112 is positioned through orifice 136 defined through wall 102*a* fluid-containing vessel 102. Flange 138 is constructed on an outer surface of fluid-containing vessel 102, surrounding orifice 136. Anode mount 132 is mechanically connected to flange 138 of vessel 102. Monitoring anode 130 is electrically isolated from vessel 102, by, for example, using a non-conductive mount 132 or having an insulator such as insulated spacer 140 positioned between anode mount 132 and vessel flange 138.

Monitoring anode assembly 112 is electrically coupled to a junction box 142 by anode electric line 144 and vessel electric line 146. Anode electric line 144 is coupled directly anode 130 and vessel electric line is coupled directly to fluid-containing vessel 102. Junction box 142 is disposed on an exterior of fluid-containing vessel and is accessible to an operator for taking measurements of voltages related to the operation of cathodic protection system 100 as described in greater detail below.

In some embodiments, monitoring anodes 130 and/or as protective anodes 114, 118 are high-temperature zinc anodes. In other embodiments, anodes 130, 114 and 118 are constructed of aluminum, an aluminum alloy, cadmium, a cadmium alloy, magnesium, a magnesium alloy or another material which has a more negative standard electrode potential than wall 102*a* of fluid-containing vessel 102. Each of anodes 130, 114 and 118 are referred to as sacrificial anodes since each is induced to corrode in order to inhibit corrosion of fluid-containing vessel 102.

Figure 2:
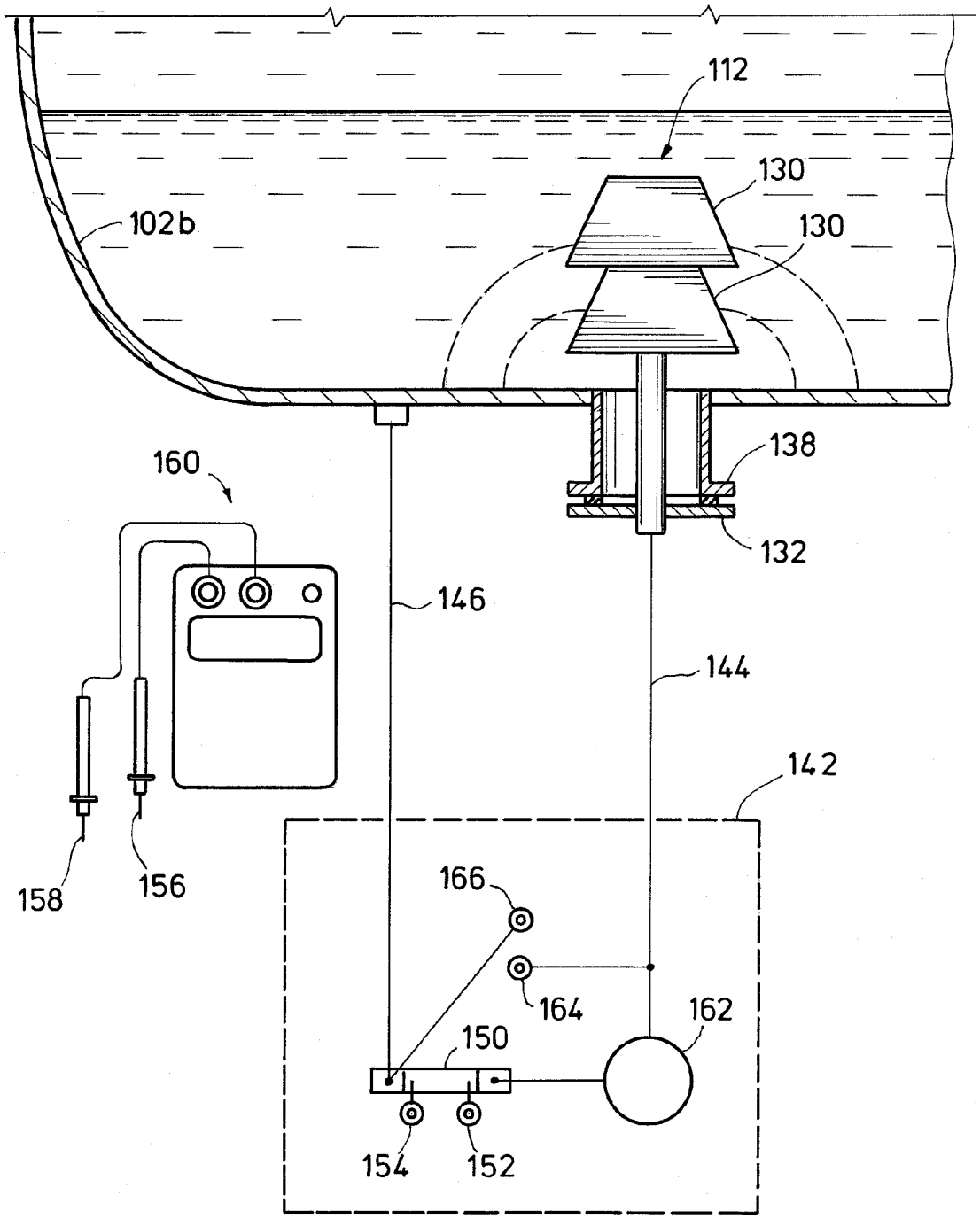
FIG. 2 is an enlarged cross-sectional view of a monitoring anode of FIG. 1 coupled to a current and potential monitoring device in accordance with an example embodiment of the present invention.

Referring now to FIG. 2, shunt 150 is disposed within junction box 142. Shunt 150 is coupled in series between anode electric line 146 and vessel electric line 146 such that all of the current flowing through cathodic protection system 100 flows through shunt 150. Shunt 150 has a known resistance such that a voltage drop measured between potential knobs 152, 154 disposed on opposite sides of shunt 150 is representative of the current flowing through cathodic protection system 100, e.g., the current output of anodes 130. Potential knobs 152, 154 are configured to protrude above a surface of junction box 142 to engagement by leads of 156, 158 of voltage meter 160. In the embodiment depicted, voltage meter 160 is a portable, hand-held device, although in other embodiments, voltage meter 160 can be affixed to potential knobs 152, 154 for continuous or intermittent voltage measurements.

Switch 162 is disposed in series between shunt 152 and anode 130. Switch 162 is a momentary switch configured to be normally closed such that current normally flows between shunt 150 and anode 130. In some embodiments, switch 162 is configured as a pushbutton operable to open the circuit while the pushbutton is depressed, and operable to return to a closed configuration when released. While switch 162 is open, a voltage measured between potential knobs 164, 166 represents a potential difference between anodes 130 and the fluid-containing vessel 102. Switch 162 is thus operable to momentarily disconnect shunt 150 to permit a measurement of voltage of the fluid-containing vessel with respect to anodes 130 as a reference. As one skilled in the art will appreciate, measurements of the voltage of the fluid-containing vessel 102 being protected with respect to anode 130, together with measurements of the current output of anode 130 can be used to assess the condition of anodes 130 and determine, for example, if the anode 130 is failing. Assessing the condition of anodes 130 of monitoring anode assembly 112 facilitates an assessment of anodes 114, 118 (FIG. 1) of protective anode assemblies 108, 110.

Figure 3:
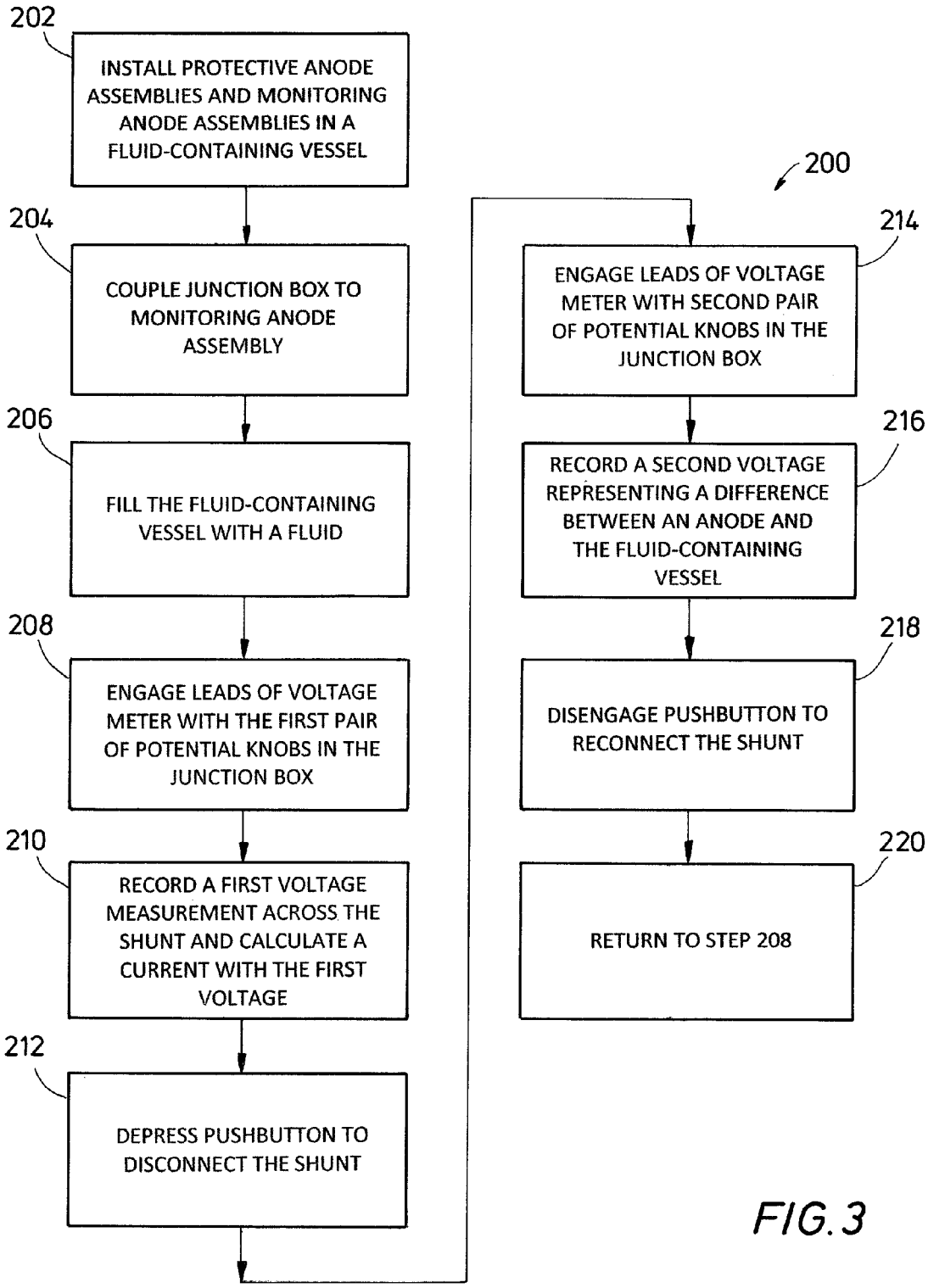
FIG. 3 is a flow diagram illustrating an example method for providing cathodic protection to a fluid-containing vessel in accordance with an example embodiment of the present invention.

Referring now to FIG. 3, an embodiment of a method 200 of monitoring the condition of monitoring anode 130 of the cathodic protection system 100 (FIG. 1) is illustrated. Initially, one or more protective anode assemblies 108, 110 and one or more monitoring anode assemblies 112 are installed within fluid-containing vessel 102 (step 202). The protective anodes 114, 118 are mounted to the interior surface 102*b* either directly or by an anode mount 120. Next, the junction box 142 is coupled to the monitoring anodes 130 of monitoring anode assembly 112 (step 204). Junction box 142 is coupled to monitoring anodes 130 by anode electrical line 144 that extends through wall 102*a* of fluid-containing vessel 102. Junction box 142 is also coupled to wall 102*a* by vessel electrical line 146. Next, fluid-containing vessel 102 is filled with fluid 104, 106 (step 206) such that the fluid 106 contacts protective anodes 114, 118 and monitoring anodes 130.

To monitor the condition of anodes 130, leads 156, 158 of voltage meter 160 (FIG. 2) are engaged with the first pair of potential knobs 152, 154 (step 208). A first voltage is recorded across the shunt 150, and a current is calculated from the first voltage and a known resistance of the shunt (step 210). Next, switch 162 is opened by depressing the associated pushbutton (step 212). Momentarily opening switch 162 serves to inhibit or interrupt current flow through shunt 150 and thereby permits a voltage measurement between anode electrical line 144 and vessel electrical line 146 that is representative of a voltage difference between monitoring anodes 130 and wall 102*b* of fluid-containing vessel 102. Leads 156, 158 are engaged with the second pair of potential knobs 164, 166 while the pushbutton is depressed and switch 162 is momentarily opened (step 214). A second voltage is recorded (step 2216) between potential knobs 166, 164 that is representative of a voltage difference between anodes 130 and an interior surface of wall 102*b* of fluid-containing vessel 102. The pushbutton is released to disengage momentary switch 162 to restore current through shunt 150 (step 218). In this manner, the protective circuit is restored and fluid-containing vessel 102 continues to be protected by cathodic protection system 100 without additional action by an operator. After an appropriate time interval, measurements can be repeated (step 220) by repeating steps 208 through 216.

In this manner, the appropriate voltage and current values are determined for monitoring a wear condition of monitoring anodes 130 without the need for physically disconnecting shunt 150. This procedure thus facilitates monitoring the condition of cathodic protection system 100 without the dangers associated with physically disconnecting shunt 150 sparks that lead to explosions, inadvertent failure to reconnect shunt 150, and/or wasted time and effort. Monitoring anodes 130 serve as a reference anode for assessing a condition of cathodic protection system 100.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A cathodic protection system comprising:

a fluid-containing vessel having a wall defining an interior surface;

a fluid disposed within the fluid-containing vessel and contacting the interior surface;

a plurality of protecting anodes disposed within the fluid-containing vessel and spaced apart from one another, each of the plurality of protecting anodes contacting the fluid and being directly connected to the interior surface of the wall through an electrical conduit isolated from the fluid;

a monitoring anode assembly comprising:

one or more monitoring anodes disposed within the fluid-containing vessel, wherein the one or more monitoring anodes comprises a galvanic anode, wherein the one or more monitoring anodes is mounted on an anode mount positioned through an orifice defined through the wall of the fluid-containing vessel; and a flange constructed on an outer surface of the fluid-containing vessel surrounding the orifice, wherein the one or more monitoring anodes is electrically isolated from the vessel by mechanically connecting the anode mount to the flange of the vessel using a non-conductive mount or by positioning an insulator between the anode mount and the flange of the vessel; and a junction box disposed on an exterior of the fluid-containing vessel, the junction box comprising:

a shunt coupled between an anode electrical line and a vessel electrical line, wherein the anode electrical line extends from the one or more monitoring anodes through the wall of the fluid-containing vessel to the shunt, wherein the vessel electrical line extends from the wall of the fluid-containing vessel to the shunt, and wherein the shunt has a known electrical resistance such that a current through the shunt is calculable from a measurement of a voltage across the shunt; and a momentary switch disposed in one of the anode electrical line and the vessel electrical line, the momentary switch having a normally closed configuration to permit current flow therethrough, and operable to be momentarily opened to inhibit current flow through the shunt and thereby permit a voltage measurement between the anode electrical line and the vessel electrical line that is representative of a voltage difference between the one or more monitoring anodes and the wall of the fluid-containing vessel.

2. The cathodic protection system according to claim 1, further comprising one or more anode mounts coupled to the interior surface, wherein one or more protecting anodes of the plurality of protecting anodes are mounted on the one or more anode mounts, and wherein the one or more anode mounts provide the electrical conduit isolated from the fluid.

3. The cathodic protection system according to claim 2, wherein a respective electrical conduit that is isolated from the fluid extends through the anode mount to which a respective one of the protecting anodes of the plurality of protecting anodes is mounted.

4. The cathodic protection system according to claim 1, wherein one or more of the protecting anodes of the plurality of protecting anodes are mounted directly to the interior surface.

5. The cathodic protection system according to claim 1, further comprising an impressed current source electrically connected to one or more of the plurality of protecting anodes and to the wall of the fluid-containing vessel such that the fluid-containing vessel serves as a cathode when current is applied from the impressed current source.

6. The cathodic protection system according to claim 1, wherein the junction box further comprises a first pair of potential knobs protruding from a surface thereof and disposed on opposite sides of the shunt to facilitate the measurement of the voltage across the shunt.

7. The cathodic protection system according to claim 6, wherein the junction box further comprises a second pair of potential knobs to facilitate the voltage measurement between the anode electrical line and the vessel electrical line while the momentary switch is momentarily opened, a first one of the second pair of potential knobs in electrical communication with the anode electrical line and a second one of the second pair of potential knobs in electrical communication with the vessel electrical line.

8. The cathodic protection system according to claim 7, further comprising a portable, hand-held voltage meter operable to make voltage measurements between the first pair of potential knobs and between the second pair of potential knobs.

9. A method of monitoring the one or monitoring anodes of the cathodic protection system according to claim 8, the method comprising the steps of:

(a) engaging a pair of leads of the portable, hand-held voltage meter with the first pair of potential knobs and recording a first indicated voltage;

(b) engaging the momentary switch to momentarily open the momentary switch and interrupt current through the shunt;

(c) engaging the pair of leads of the portable, hand-held voltage meter with the second pair of potential knobs while current is interrupted through the shunt and recording a second voltage; and (d) disengaging the momentary switch to restore current through the shunt.

10. A cathodic protection system for providing corrosion protection to a fluid-containing vessel, the cathodic protection system comprising:

a fluid-containing vessel defining an interior chamber for containing a fluid therein;

one or more sacrificial anodes disposed within the interior chamber;

a shunt disposed on an exterior of the fluid-containing vessel, the shunt having a known electrical resistance such that a current through the shunt is calculable from a measurement of a voltage across the shunt;

an anode electrical line extending through a wall of the fluid-containing vessel from one or more monitoring anodes to a first end of the shunt, wherein the one or more monitoring anodes comprises a galvanic anode, wherein the one or more monitoring anodes is mounted on an anode mount positioned through an orifice defined through the wall of the fluid-containing vessel;

a flange constructed on an outer surface of the fluid-containing vessel surrounding the orifice, wherein the one or more monitoring anodes is electrically isolated from the vessel by mechanically connecting the anode mount to the flange of the vessel using a non-conductive mount or by positioning an insulator between the anode mount and the flange of the vessel;

a vessel electrical line extending from the fluid-containing vessel to a second end of the shunt such that the shunt is connected in series between the anode electrical line and the vessel electrical line; and a momentary switch disposed in one of the anode electrical line and the vessel electrical line, the momentary switch having a normally closed configuration to permit current flow therethrough, and operable to be momentarily opened to interrupt current flow through the shunt and thereby permit a voltage measurement between the anode electrical line and the vessel electrical line that is representative of a voltage difference between the one or more sacrificial anodes and a wall of the fluid-containing vessel.

11. The cathodic protection system according to claim 10, wherein the shunt and the momentary switch are disposed within a junction box disposed on the exterior of the fluid-containing vessel.

12. The cathodic protection system according to claim 11, further comprising a first pair of potential knobs disposed within the junction box on opposite sides of the shunt to facilitate the measurement of the voltage across the shunt.

13. The cathodic protection system according to claim 12, further comprising a second pair of potential knobs to facilitate the voltage measurement between the anode electrical line and the vessel electrical line while the momentary switch is momentarily opened, a first one of the second pair of potential knobs in electrical communication with the anode electrical line and a second one of the second pair of potential knobs in electrical communication with the vessel electrical line.

14. The cathodic protection system according to claim 10, wherein the fluid-containing vessel comprises a dehydrator for handling wet crude, and wherein the one or more sacrificial anodes are disposed along a lower interior surface of the fluid-containing vessel within the interior chamber thereof.

15. The cathodic protection system according to claim 10, wherein the one or more sacrificial anodes disposed within the interior chamber includes one or more monitoring anodes electrically coupled directly to the anode electrical line and one or more protecting anodes electrically isolated from the anode electrical line except through the fluid-containing vessel or the fluid contained therein.

16. The cathodic protection system according to claim 10, wherein the one or more sacrificial anodes comprises at least one high temperature zinc anode.

* * * * *